US010337679B2

(12) United States Patent
Brannon et al.

(10) Patent No.: US 10,337,679 B2
(45) Date of Patent: Jul. 2, 2019

(54) MODULAR BAY LUMINAIRE

(71) Applicant: Hubbell Incorporated, Shelton, CT (US)

(72) Inventors: Derek E. Brannon, Greenville, SC (US); Thomas Holscher, Simpsonville, SC (US); Joseph Engle, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 43 days.

(21) Appl. No.: 15/294,293

(22) Filed: Oct. 14, 2016

(65) Prior Publication Data

US 2017/0108184 A1 Apr. 20, 2017

Related U.S. Application Data

(60) Provisional application No. 62/242,596, filed on Oct. 16, 2015, provisional application No. 62/325,639, (Continued)

(51) Int. Cl.
*F21V 17/10* (2006.01)
*F21S 2/00* (2016.01)
(Continued)

(52) U.S. Cl.
CPC ..... *F21S 2/005* (2013.01); *F21S 4/28* (2016.01); *F21S 8/043* (2013.01); *F21V 17/104* (2013.01); *F21V 23/06* (2013.01); *F21V 29/74* (2015.01); *F21V 29/763* (2015.01); *F21V 31/00* (2013.01); *F21V 3/02* (2013.01); *F21V 15/015* (2013.01); *F21V 21/02* (2013.01); *F21V 23/005* (2013.01);
(Continued)

(58) Field of Classification Search
CPC .... F21V 29/763; F21V 15/015; F21V 17/104; F21V 21/02; F21V 23/06; F21V 3/02; F21V 29/74; F21V 23/0471; F21V 23/005; F21V 31/00; F21S 4/28; F21S 2/005; F21S 8/043; F21Y 2115/10
See application file for complete search history.

(56) References Cited

U.S. PATENT DOCUMENTS 4,758,935 A 7/1988 Frassati et al.
5,869,786 A * 2/1999 Jaakkola ..... H01R 25/14 174/68.1
(Continued)

OTHER PUBLICATIONS

PCT/US2016/057146 International Search Report and Written Opinion dated Jan. 9, 2017 (12 pages).

*Primary Examiner* — Anh T Mai
*Assistant Examiner* — Fatima N Farokhrooz
(74) *Attorney, Agent, or Firm* — Michael Best & Friedrich, LLP

(57) ABSTRACT

A luminaire includes a rail assembly including a first rail and a second rail. A light bar assembly is releasably connected to the rail assembly extending between the first rail and the second rail. The light bar assembly includes a light bar and a light emitter connected to the light bar. A control component assembly is releasably connected to the rail assembly extending between the first rail and the second rail and operatively connected to the light bar assembly. The control component assembly includes a control component housing containing at least one control component.

21 Claims, 23 Drawing Sheets

Related U.S. Application Data filed on Apr. 21, 2016, provisional application No. 62/372,851, filed on Aug. 10, 2016.

(51) Int. Cl.

| | |
|---|---|
| ***F21V 29/76*** | (2015.01) |
| ***F21S 4/28*** | (2016.01) |
| ***F21V 23/06*** | (2006.01) |
| ***F21V 29/74*** | (2015.01) |
| ***F21S 8/04*** | (2006.01) |
| ***F21V 31/00*** | (2006.01) |
| *F21V 15/015* | (2006.01) |
| *F21V 21/02* | (2006.01) |
| *F21Y 115/10* | (2016.01) |
| *F21V 3/02* | (2006.01) |
| *F21V 23/00* | (2015.01) |
| *F21V 23/04* | (2006.01) |

(52) U.S. Cl.

CPC ..... *F21V 23/0471* (2013.01); *F21Y 2115/10* (2016.08)

(56) References Cited

U.S. PATENT DOCUMENTS

| | | | | |
|---|---|---|---|---|
| 6,517,222 | B1 | 2/2003 | Orlov | |
| 6,813,853 | B1 | 11/2004 | Tucker | |
| 8,628,212 | B2 | 1/2014 | Klu | |
| 9,395,052 | B1 | 7/2016 | Shew | |
| 9,897,294 | B2 | 2/2018 | Pearson | |
| 2003/0179578 | A1* | 9/2003 | Albert | F21V 21/15 362/276 |
| 2005/0041417 | A1* | 2/2005 | Mackin | F21S 8/04 362/147 |
| 2008/0175011 | A1* | 7/2008 | Joseph | F21S 2/00 362/407 |
| 2009/0207602 | A1* | 8/2009 | Reed | F21S 2/005 362/225 |
| 2009/0296381 | A1* | 12/2009 | Dubord | F21S 2/005 362/218 |
| 2009/0323358 | A1 | 12/2009 | Scott | |
| 2010/0254146 | A1* | 10/2010 | McCanless | F21V 15/01 362/368 |
| 2011/0211330 | A1* | 9/2011 | Wang | H05B 33/0803 362/20 |
| 2014/0126190 | A1* | 5/2014 | Dixon | F21L 4/00 362/190 |
| 2015/0016121 | A1 | 1/2015 | Kokubo | |
| 2015/0116997 | A1* | 4/2015 | Tappert | A01K 63/06 362/231 |
| 2015/0226391 | A1* | 8/2015 | Sellam | F21V 19/003 362/249.02 |
| 2016/0053973 | A1* | 2/2016 | Tress | F21S 4/28 362/217.02 |
| 2016/0327252 | A1 | 11/2016 | Ray | |
| 2016/0327256 | A1 | 11/2016 | Hall | |
| 2017/0108184 | A1 | 4/2017 | Brannon | |

* cited by examiner

MODULAR BAY LUMINAIRE

RELATED APPLICATION

This application is based on U.S. Provisional Application Ser. No. 62/242,596, filed Oct. 16, 2015, U.S. Provisional Application Ser. No. 62/325,639, filed Apr. 21, 2016, and U.S. Provisional Application Ser. No. 62/372,851 filed Aug. 10, 2016, the disclosures of which are incorporated herein by reference in their entirety and to which priority is claimed.

FIELD

Various exemplary embodiments relate to light fixtures or luminaires, for example indoor luminaires.

BACKGROUND

Light fixtures, or luminaires, are used with electric light sources to provide an aesthetic and functional housing in both interior and exterior applications. For example, highbay and lowbay luminaires can be used in larger open indoor environments such as heavy industrial settings, warehouses, gyms, churches, and shopping malls.

SUMMARY

According to an exemplary embodiment, a luminaire includes a rail assembly including a first rail and a second rail. A light bar assembly is releasably connected to the rail assembly extending between the first rail and the second rail. The light bar assembly includes a light bar and a light emitter connected to the light bar. A control component assembly is releasably connected to the rail assembly extending between the first rail and the second rail and operatively connected to the light bar assembly. The control component assembly includes a control component housing containing at least one control component.

According to another exemplary embodiment, a luminaire includes a rail assembly with a first rail having a first channel and a second channel and a second rail having a third channel and a fourth channel. A light bar assembly is connected to the first channel and the third channel. A control component assembly is connected to the first channel and the third channel. A mounting component is connected to the second channel and the fourth channel.

In another exemplary embodiment, a method of assembling a luminaire includes selecting a first rail and a second rail of a desired length. Two or more light bar assemblies are selected and connected to the first and second rail. A control component assembly is selected and connected it to the first and second rail. The control component assembly is operatively connected to the selected light bar assemblies.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
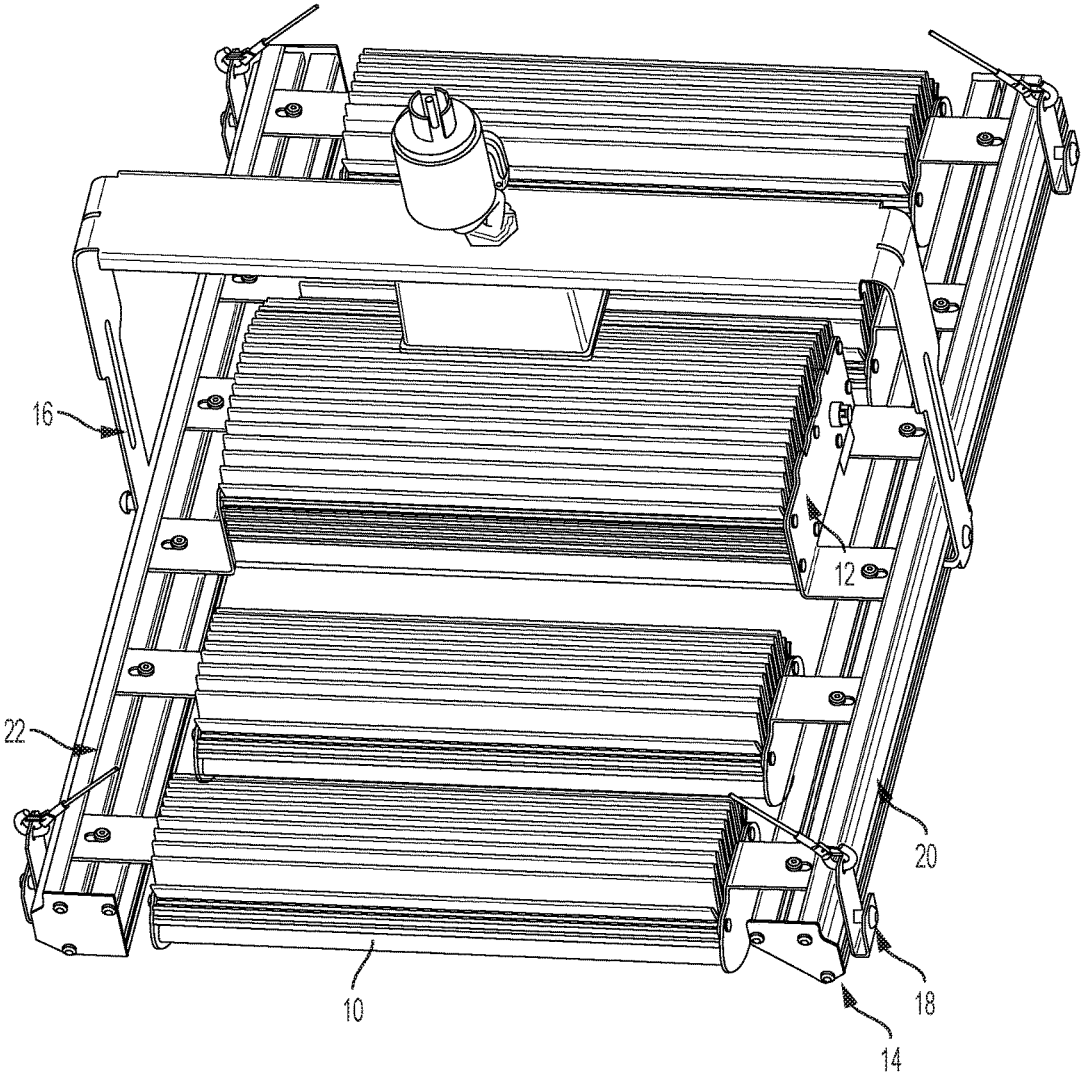
FIG. 1 is a top perspective view of an exemplary luminaire.
Figure 2:
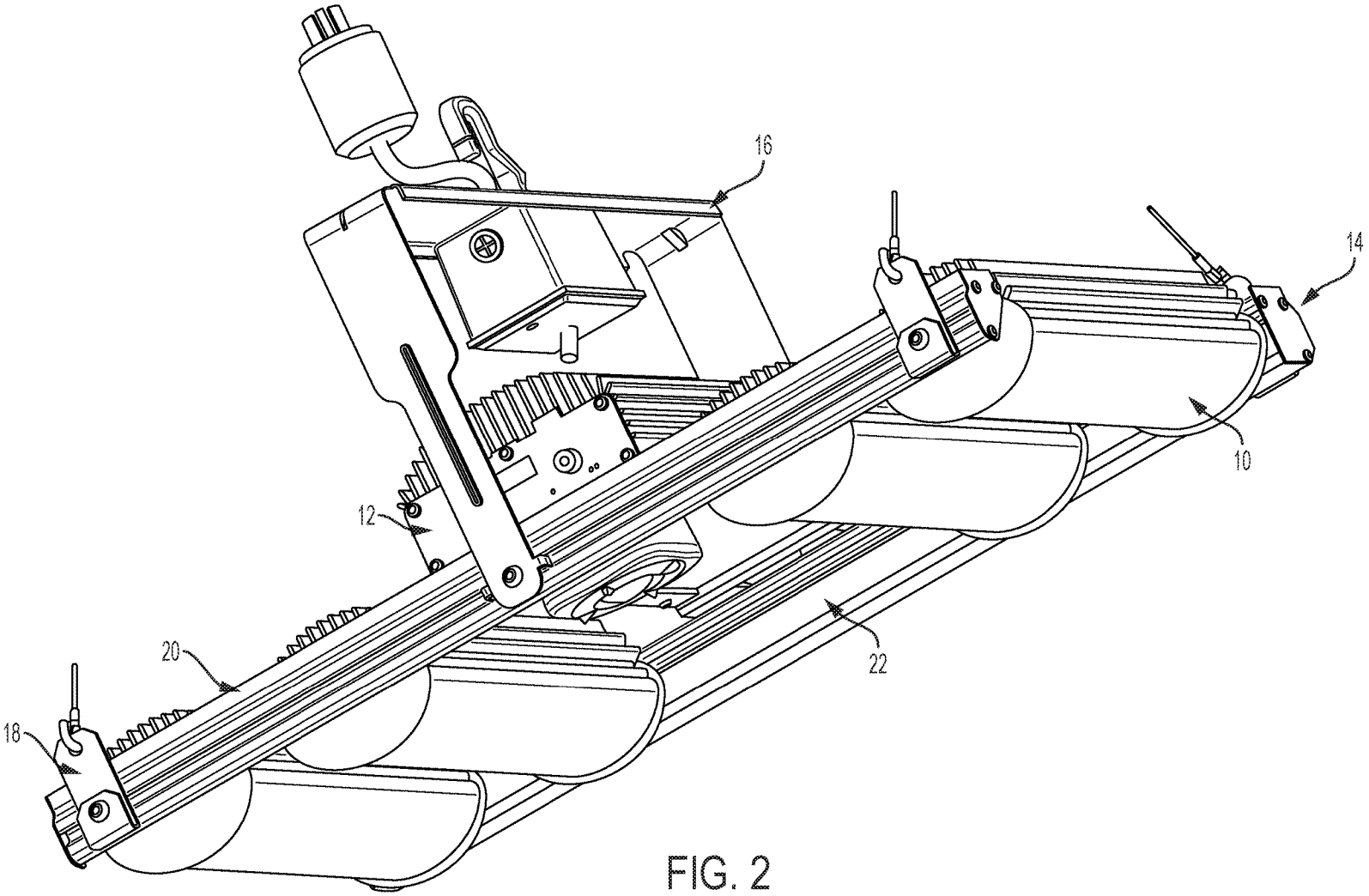
FIG. 2 is a bottom perspective view of FIG. 1.
Figure 3:
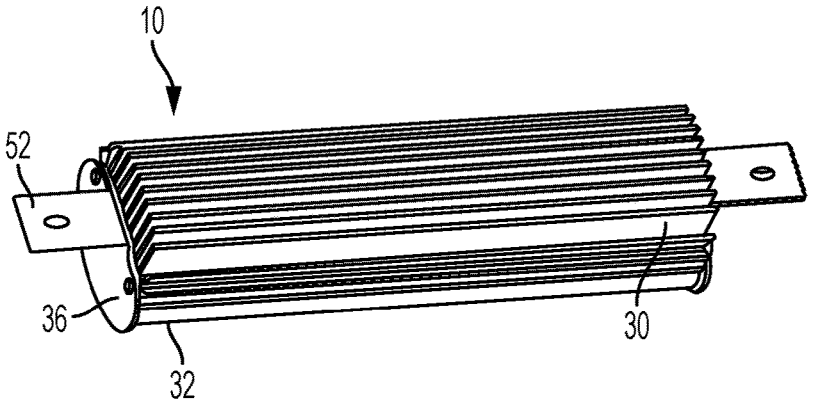
FIG. 3 is a top perspective view of an exemplary light bar assembly.
Figure 4:
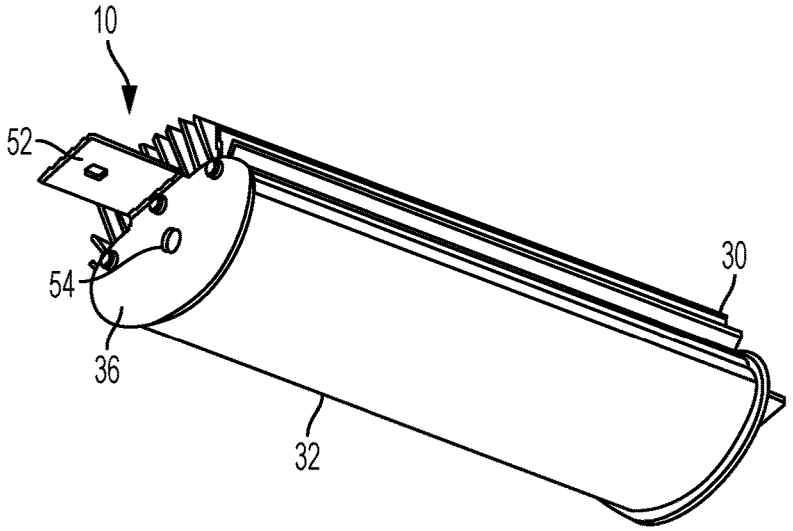
FIG. 4 is a bottom perspective view of FIG. 3.
Figure 5:
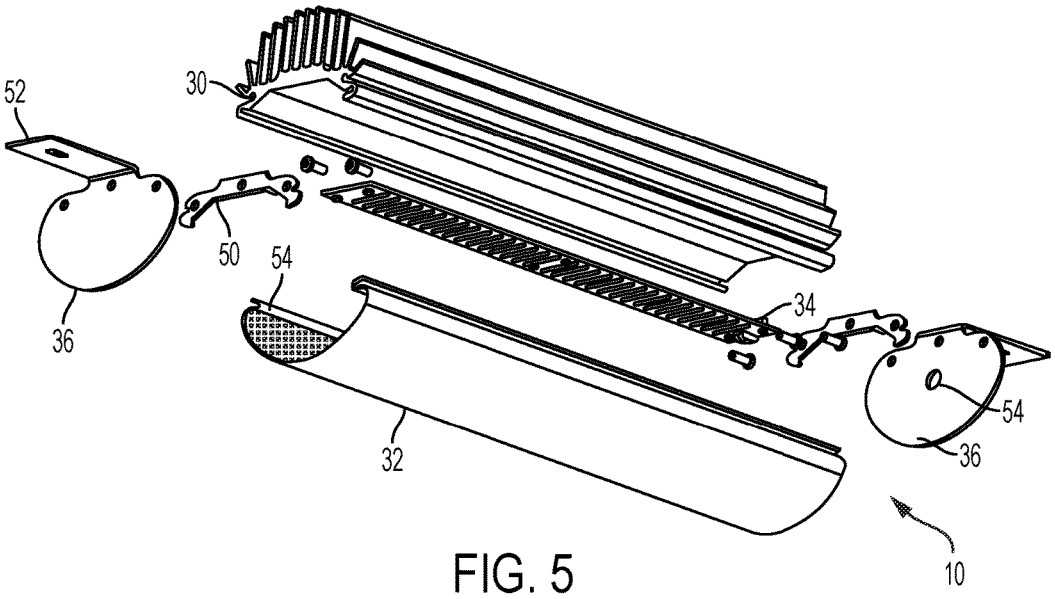
FIG. 5 is an exploded view of FIG. 4.
Figure 6:
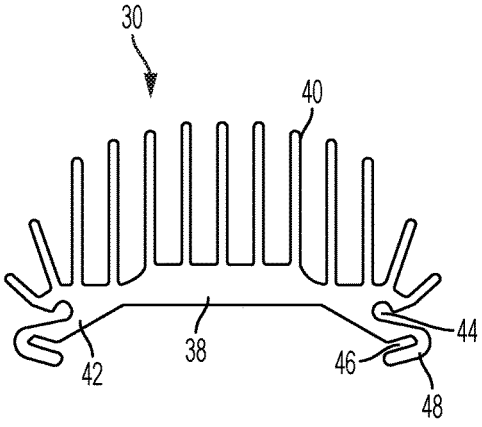
FIG. 6 is a side view of an exemplary light bar.
Figure 7:
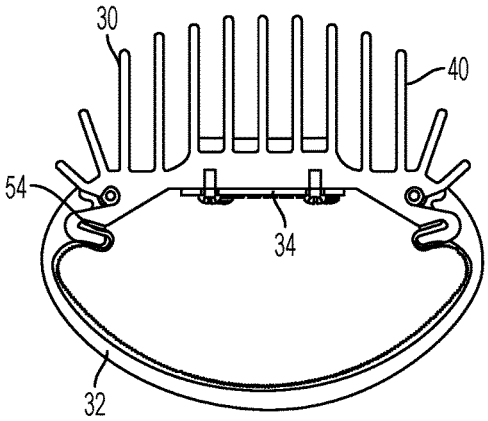
FIG. 7 is a side, sectional view of FIG. 4.

According to various exemplary embodiments, a luminaire includes one or more light bar assemblies 10 and one or more control component assemblies 12, connected to a rail assembly 14. The rail assembly 14 provides support and an attachment point for the light bar assemblies 10 and the control component assemblies 12. FIGS. 1 and 2 show an exemplary embodiment of a luminaire utilizing a center positioned control component assembly 12 with two light bar assemblies 10 positioned on each side of the control component assembly 12. The rail assembly 14 can also be connected to different types of mounting components that are used to retain the luminaire in a desired location, for example suspended from a wall or ceiling. FIGS. 1 and 2 show a yoke assembly 16 and cable assemblies 18 connected to the rail assembly 14 for supporting the luminaire, although only one may need to be used and other mounting components can be used. In an exemplary embodiment, the rail assembly 14 includes a first rail 20 and a second rail 22. The first and second rails 20, 22 are elongated and positioned substantially parallel to one another with the light bar assemblies 10 and control component assembly extending therebetween. Some embodiments can utilize fewer rail members, for example a single unitary rail member extending at least partially around the light bar assemblies 10 and control component assemblies 12, or more than two rail members.

FIGS. 3-7 show an exemplary embodiment of a light bar assembly 10 that includes a light bar 30, a lens 32, a light emitter 34, and a pair of endplates 36. The light bar 30 has a substantially elongated configuration that extends between the first rail 20 and the second rail 22. The light bar 30 includes a base 38 for receiving one or more light emitters 34. A plurality of fins 40 for dissipating heat generated by the light emitters 34 extend away from the base 38 opposite the light emitters 34. A pair of side arms 42 extend from the base 38 with one arm 42 on each side. In an exemplary embodiment, the arms 42 extend down from the base 38 at an angle away from center of the base 38. Each arm 42 includes a first channel 44 and a second channel 46. The second channel 46 is at least partially defined by a hook member 48. The first channel 44 provides a connection for the endplates 36, for example through a fastener. The second channel 46 provides a connection for the lens 32, for example through a snap-fit connection.

The first and second endplates 36 are connected to opposite ends of the light bar 30. A gasket 50 can be positioned between the endplates 36 and the light bar 30. One or more fasteners are used to connect the endplates 36, for example a fastener extends through the endplates 36, the gasket 50, and into the first channel 42 to secure the endplate 36 to the light bar 30. The endplates 36 include a connection feature to connect the light bar assembly 10 to the rail assembly 14. In an exemplary embodiment the connection feature includes a tab 52 that extends from the endplate 36 to engage the rail assembly 14. The tab 52 includes an opening for receiving a mechanical fastener. A conduit 54 can be formed in one of the endplates 36 to allow the light emitters 34 to be electrically connected to one or more control components. The conduit 54 can receive one or more conductors connecting to the light emitters 34 or a connector, for example a type 2 wire connector, can be positioned in the conduit. Different types of connectors can be used, including various industry standard connectors. A gasket can also be positioned in the conduit 54.

Figure 8:
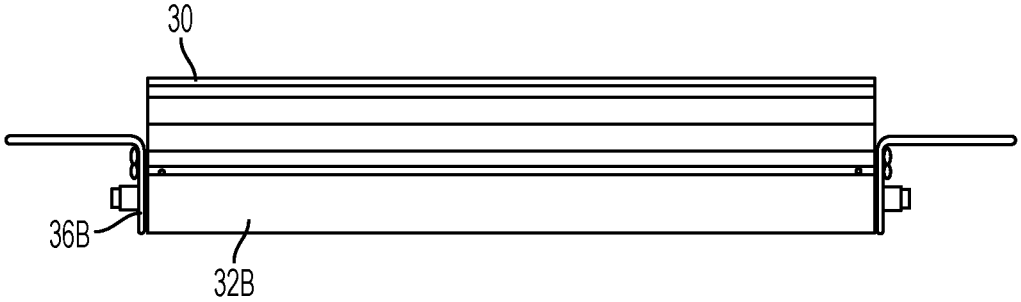
FIG. 8 is a front view of an exemplary light bar assembly with a flat lens.
Figure 9:
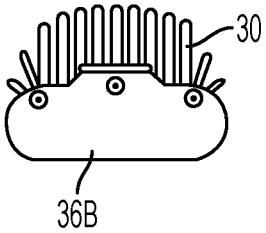
FIG. 9 is a side view of FIG. 8.
Figure 10:
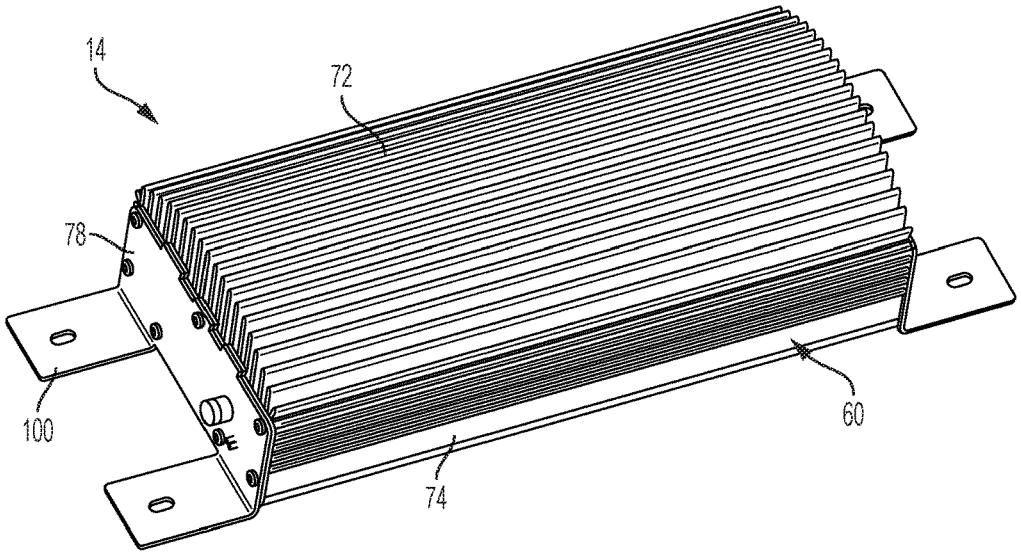
FIG. 10 is a top perspective view of an exemplary control component assembly.
Figure 11:
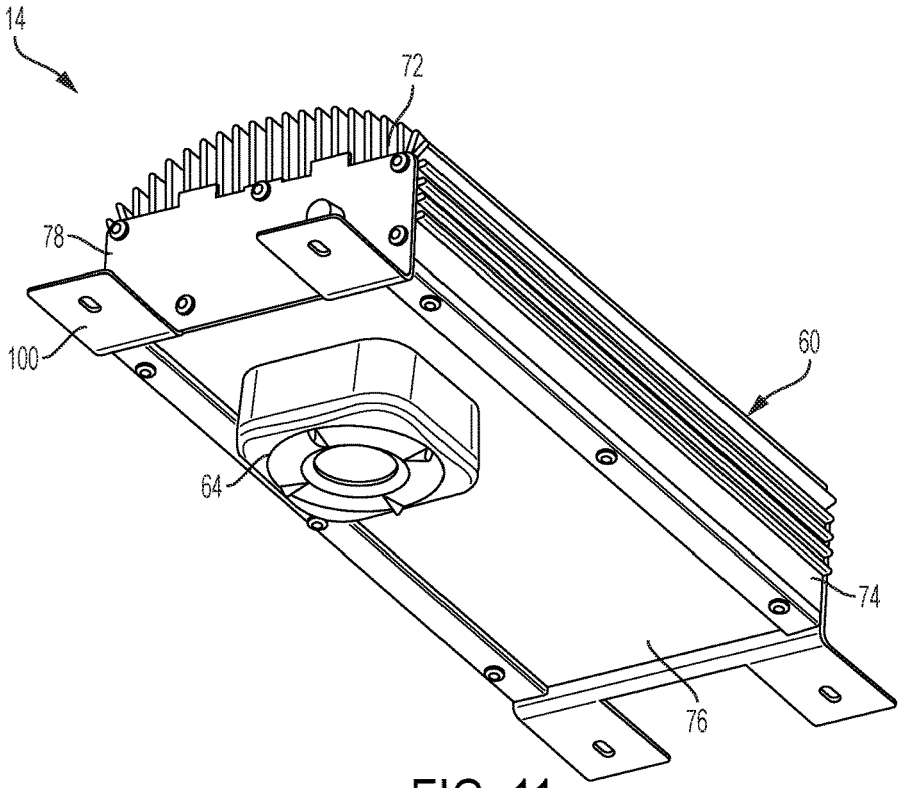
FIG. 11 is a bottom perspective view of FIG. 10.

In an exemplary embodiment, the lens 32 includes first and second hooks 54 that connect to the second channels 46 in the light bar 30. The lens 32 can be flexed so that the hooks 54 can be removable engaged. Different types of lenses 32 can be connected to the light bar 30. The lenses 32 can include different sizes, shapes, materials, and optical features or characteristics. FIGS. 3-7 show an exemplary embodiment of a round or curvilinear lens 36 and FIGS. 8 and 9 show an exemplary embodiment of a flat lens 32B. The size, shape and configuration of the light bar endplates 36B can be altered to correspond to the size and the shape of the lens 32B. The lenses 32 can include various optical features that direct or diffuse modify the light output, for example by directing, focusing, or diffusing, the emitted light. Certain exemplary embodiments can utilize different frames, seals, covers, guards, or other safety features that are suitable or required for certain environments.

Any size, shape, or configuration of light bar 30 can be used and the size, type, spacing, and configuration of fins 40 can be varied as needed. The light bar 30 can be made from a variety of materials and by a variety of manufacturing processes. In an exemplary embodiment, an extrusion process is used to form the light bar 30 to any desired length.

Different types of light emitters 34 can be connected to the light bar 30 depending on the application and the desired light output. In various exemplary embodiments, the light emitter 34 is an LED array that includes a plurality of LEDs mounted on a printed circuit board (PCB). The PCB connects to the base 38 of the light bar 30, for example through one or more mechanical fasteners. A connector extends from the PCB. The number, size, spacing, and configuration of the LEDs on the PCB can be varied depending on light output and thermal management considerations. For example, each light bar assembly 10 can utilize a light emitter 34 that is configured to emit approximately 7-7.5 k lumens and the desired light output can be increased by adding additional light bar assembly 10. In other exemplary embodiments, the light emitter 34 can be configured to output between 5-12 k lumens. Fewer lumens can be used in lowbay applications of the disclosed embodiments.

Figure 12:
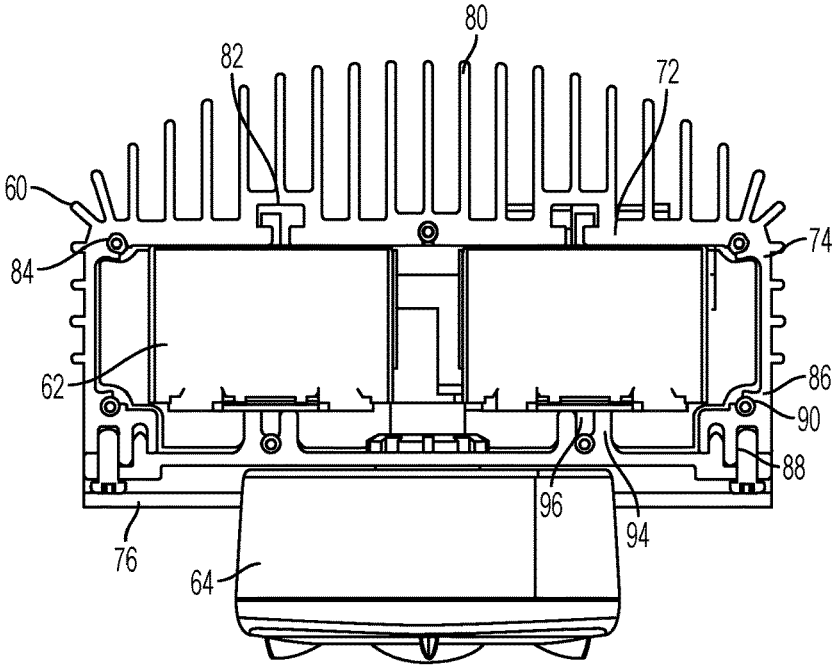
FIG. 12 is a side, sectional view of FIG. 10.
Figure 13:
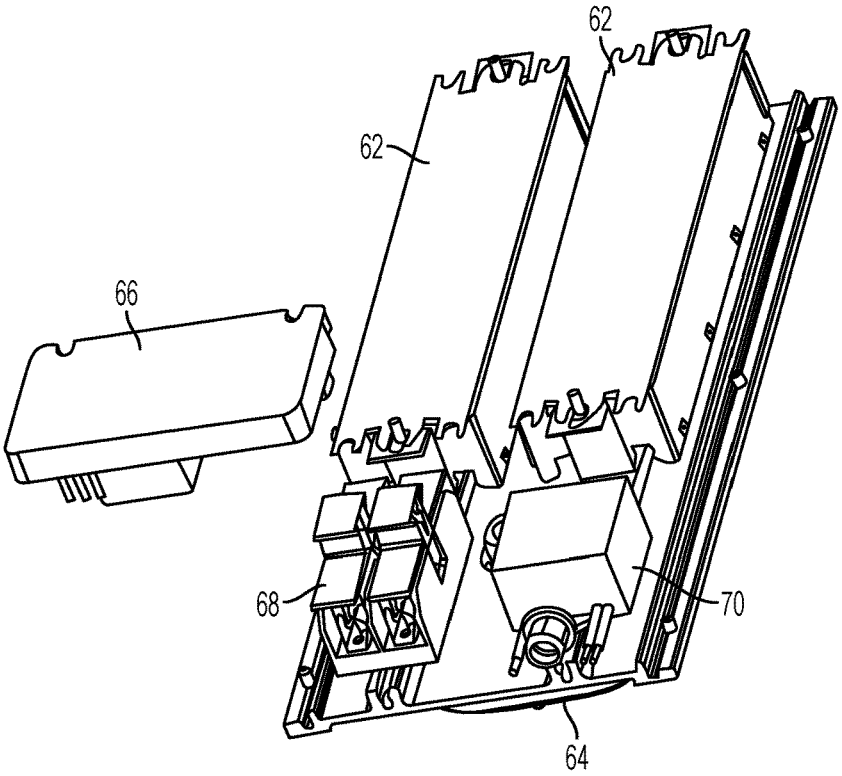
FIG. 13 is a partially exploded view of the control component assembly with the top and side walls and the endplates removed.

FIGS. 10-16 show an exemplary embodiment of a control component assembly 12 having a control housing 60 containing one or more control components. FIGS. 12 and 13 best show an exemplary set of control components that include a pair of drivers 62, a sensor 64, a control module 66, a fuse assembly 68, and a surge protector 70. Examples of sensors 64 include occupancy sensors, photo-sensors, and combination sensors. The control module 66 can be a wireless control module. Examples of suitable control modules 66 are the wiHubb or wiScape control and communication modules by Hubbell Lighting, although other wireless controls and sensors can also be used. Other devices for regulating power to, and controlling the light output of, the light bar assembly 10 can also be incorporated into the control housing 60. The control components can be connected to the control housing 60 through mechanical fasteners such as brackets, screws, bolts, etc. In other embodiments, the sensor 64 may be omitted or replaced with another type of sensor.

Figure 14:
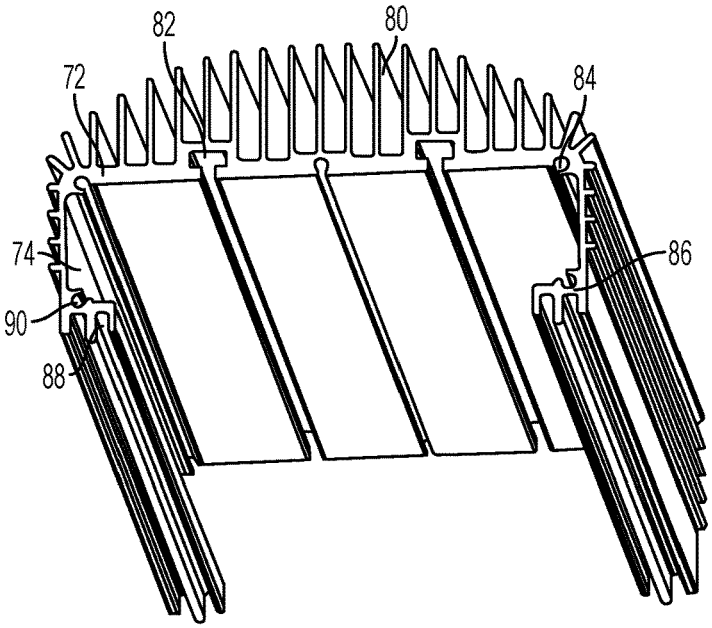
FIG. 14 is a bottom perspective view of an exemplary top wall and side walls.
Figure 15:
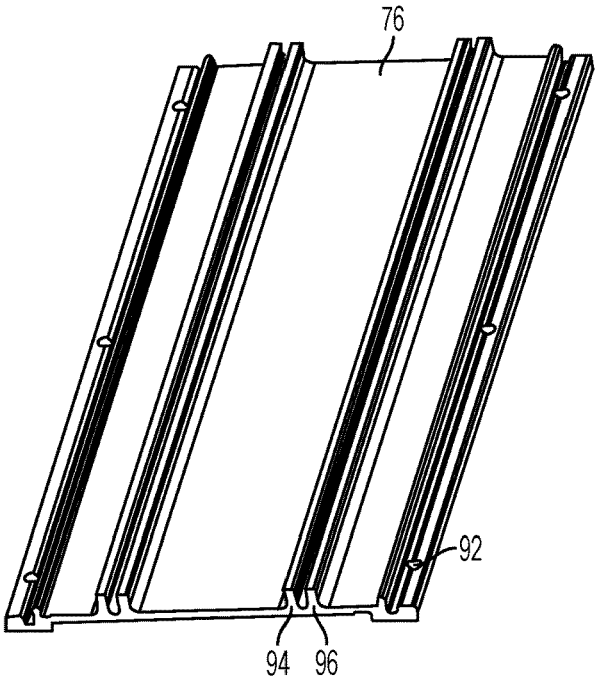
FIG. 15 is a top perspective view of an exemplary bottom wall.
Figure 16:
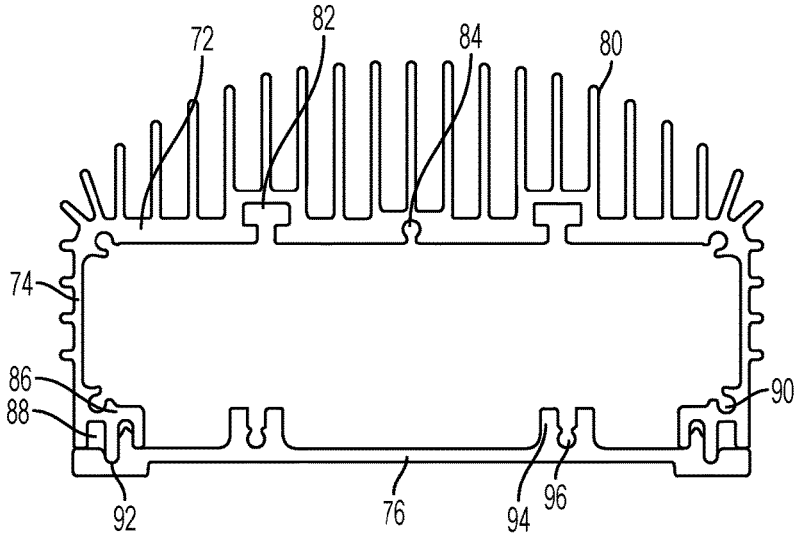
FIG. 16 is a side view of the top wall, side walls, and bottom wall.

The control housing 60 has a substantially elongated configuration that extends between the first rail 20 and the second rail 22. The control housing 60 includes a top wall 72, pair of side walls 74, a bottom wall 76, and first and second end plates 78 defining an interior for receiving one or more control components. FIGS. 14-16 shows an exemplary embodiment of the top wall 72 and the side walls 74 integrally formed, while the bottom wall 76 is releasably connected to the side walls 74. A plurality of fins 80 for dissipating heat generated by the control components extend from the top wall 72 and the side walls 74. A plurality of channels are formed in the top wall 72 to receive and/or connect various components. In an exemplary embodiment the top wall 72 channels include a first set of channels 82 having a rectilinear configuration and a second set of channels 84 having a curvilinear configuration, although other shapes and configurations can be used. According to an exemplary configuration, the first set of channels 82 receive fasteners that connect the drivers 62 or other control components, while the second set of channels 84 receive fasteners to connect the endplates 78.

The side walls 74 each include a protrusion 86 extending into the interior and defining a plurality of channels to connect various components. In an exemplary embodiment the side wall 74 channels include a first set of channels 88 having a rectilinear configuration and a second set of channels 90 having a curvilinear configuration, although other shapes and configurations can be used. According to an exemplary configuration, the first set of channels 88 receive fasteners that connect the bottom wall 76 while the second set of channels 90 receive fasteners to connect the endplates 78.

The bottom wall 76 includes a pair of outer grooves 92 and a first and second set of interior protrusions 94 that define a pair of channels 96. The outer grooves 92 can mate with the side wall protrusion 86 to position the bottom wall 76. The bottom wall 76 channels 96 are used to connect one or more of the control components. For example, the channels 96 can receive fasteners that connect to the control components or to various brackets or mounting plates used to retain the control components. The size, shape, and configuration of the channels 96 can vary. Although not shown, various openings can be provided in or through the bottom wall 76 to connect control components, such as the sensor 64.

The first and second endplates 78 are connected to opposite ends of the control housing 60. A gasket 98 can be positioned between the endplates 78 and the control housing 60. One or more fasteners are used to connect the endplates 78, for example fasteners extend through the endplates 78, the gasket 98, and into the channels on the top wall 72, side wall 74, and bottom wall 76. The endplates 78 include a connection feature to connect the control component assembly 12 to the rail assembly 14. In an exemplary embodiment the connection feature includes a pair of tabs 100 that extend from the endplate 78 to engage the rail assembly 14. Each tab 100 includes an opening for receiving a fastener.

Figure 17:
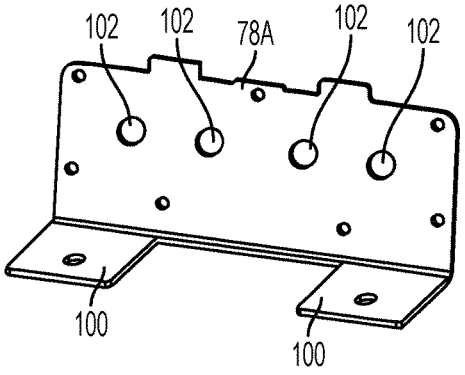
FIG. 17 is a perspective view of an exemplary endplate.
Figure 18:
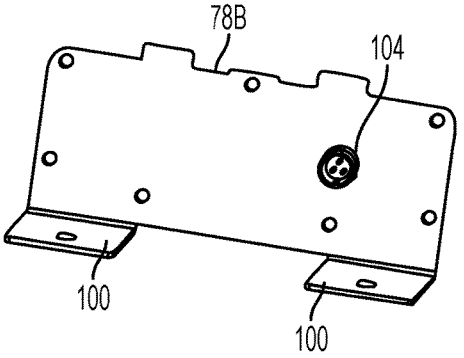
FIG. 18 is a perspective view of another exemplary endplate.

Conductors pass through the control housing 60 to be connected from a source to the control components and form the control components to the light bar assemblies 10. FIG. 17 shows an exemplary embodiment of a first endplate 78A having a series of openings 102. Conductors can pass through these openings or one or more connectors or gasket can be selectively positioned in the openings. FIG. 18 shows an exemplary embodiment of a second endplate 78B having a connector 104 positioned in a conduit, for example a type 2 wire connector. In an exemplary embodiment the connector 104 receives a power input and the openings 102 are used to output power to the light bar assemblies 10, for example through a conductor or a connector extending through the openings 102. The first endplate 78A can be formed with as many light bar assemblies 10 that are being powered by the control component assembly 12, or any extra openings 102 can be left open or plugged.

Figure 19:
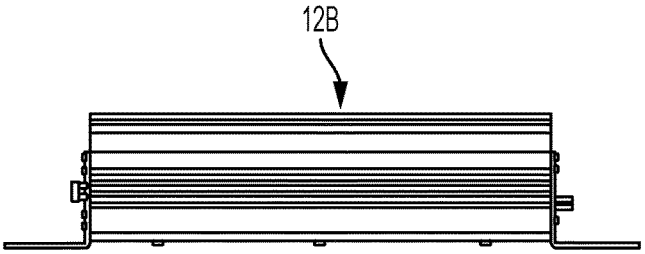
FIG. 19 is a front view of another exemplary control component assembly.
Figure 20:
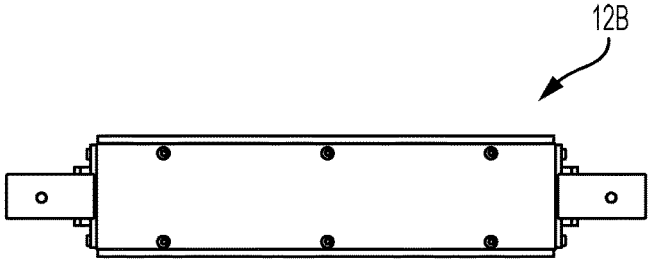
FIG. 20 is a bottom view of FIG. 19.
Figure 21:
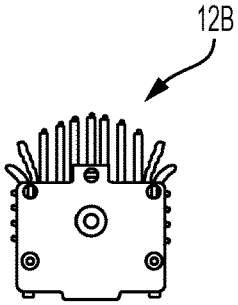
FIG. 21 is a side view of FIG. 19.

Any size, shape, or configuration of control housing 60 can be used and the size, type, spacing, and configuration of fins 80 can be varied as needed. The control housing 60 can be made from a variety of materials and by a variety of manufacturing processes. In some embodiments, an extrusion process is used to form the control housing 60 to any desired length. FIGS. 10-18 show an exemplary embodiment of a dual driver control housing 60. In certain embodiments, fewer control components are needed and the housing can be made smaller. For example, FIGS. 19-21 show an exemplary embodiment of a control component assembly 12B housing a single driver.

Figure 22:
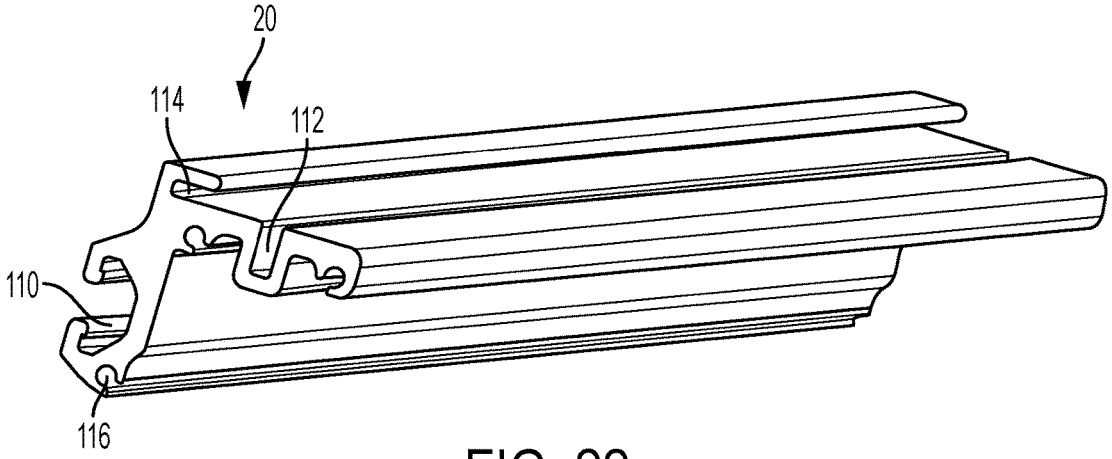
FIG. 22 is a perspective view of an exemplary first rail.
Figure 23:
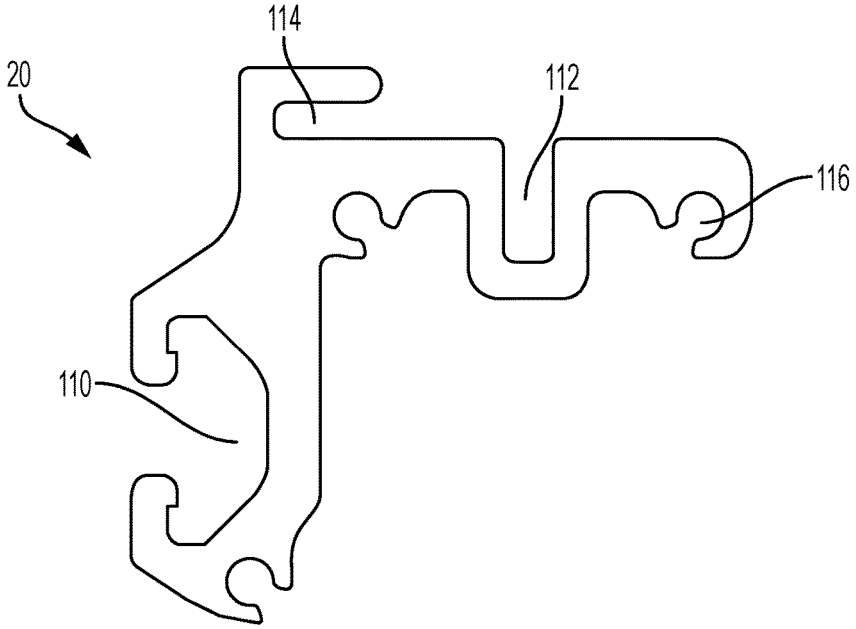
FIG. 23 is a front view of FIG. 22.
Figure 24:
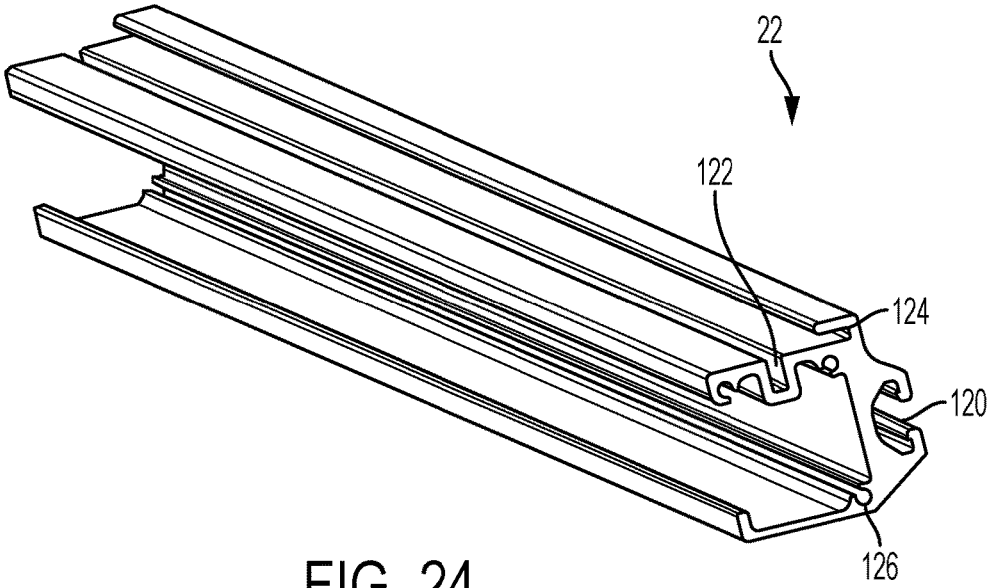
FIG. 24 is a perspective view of an exemplary second rail.
Figure 25:
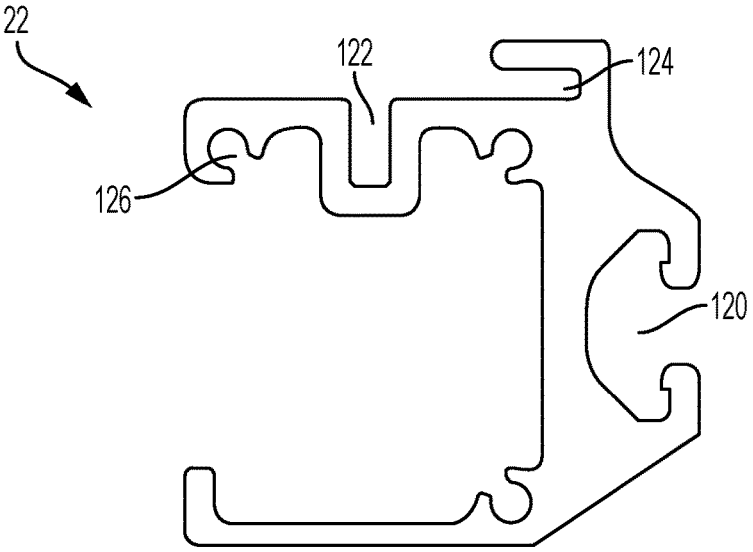
FIG. 25 is a front view of FIG. 24.

FIGS. 22 and 23 show an exemplary embodiment of a first rail 20 and FIGS. 24 and 25 show an exemplary embodiment of a second rail 22. The first and second rails 20, 22 can be made from a variety of materials and by a variety of manufacturing processes. In an exemplary embodiment, an extrusion process is used to form the first and second rails 20, 22 to any desired length. The first and second rails 20, 22 include various different connecting features to attach different components to the rail assembly, including the light bar assemblies 10, control component assemblies 12, and mounting components.

Figure 26:
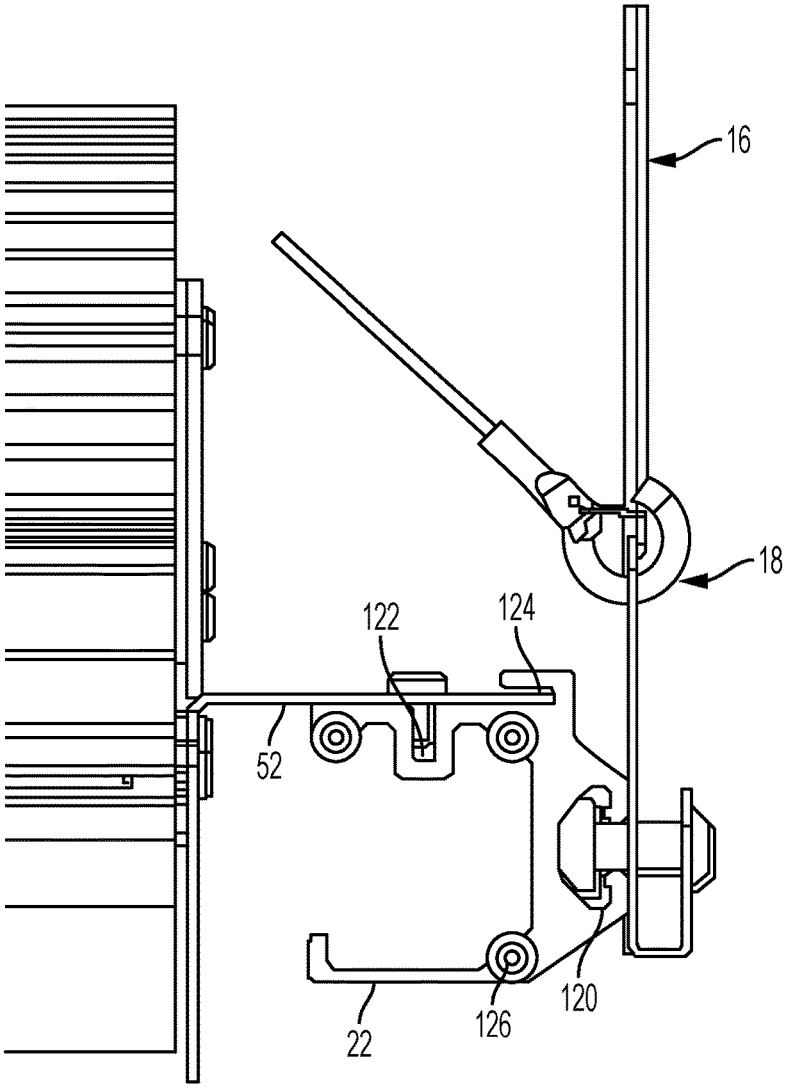
FIG. 26 is a partial, enlarged front view of the luminaire of FIG. 1 showing the second rail and different mounting components connected thereto.

In an exemplary embodiment the connecting features of the first rail 20 include a side channel no, an upper channel 112, an upper slot 114, and one or more inner channels 116. In an exemplary embodiment, the connecting features of the second rail 22 include a side channel 120, an upper channel 122, an upper slot 124, and one or more inner channels 126. As shown in FIG. 26, the side channels 110, 120 are configured to receive a fastener that can connect the yoke assembly 16 and the cable assembly 18. The upper channels 112, 122 receive fasteners that extend through the openings in the endplate tabs 52, 100. The upper slots 114, 124 receive the endplate tabs 52, 100. The inner channels 116, 126 are configured to receive fasteners that connect endplates to the first and second rails 20, 22. The exemplary embodiment shows a rail having three sides that at least partially define an interior portion, although other shapes and configurations can be used.

Figure 27:
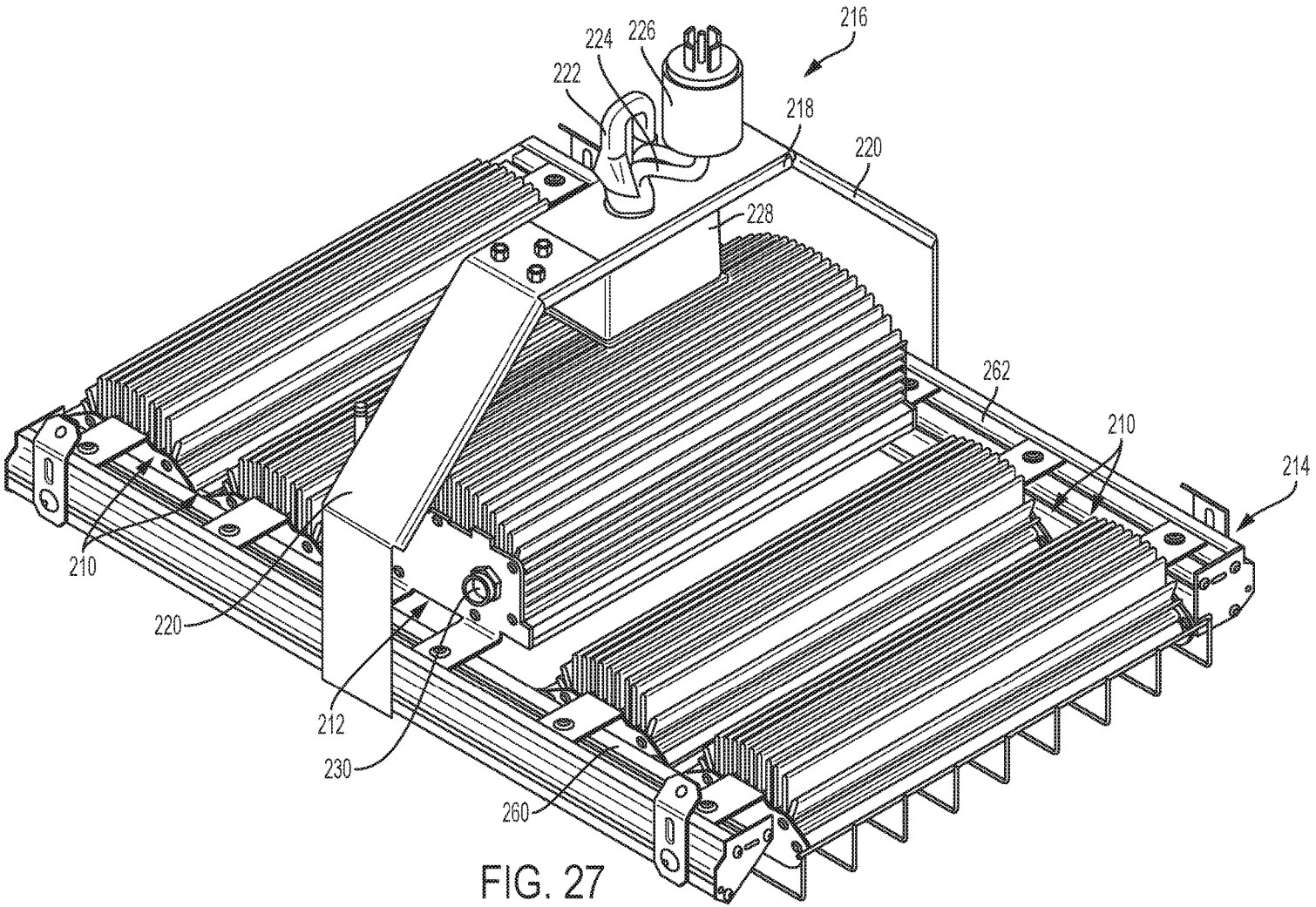
FIG. 27 is a top perspective view of a luminaire according to another embodiment.
Figure 28:
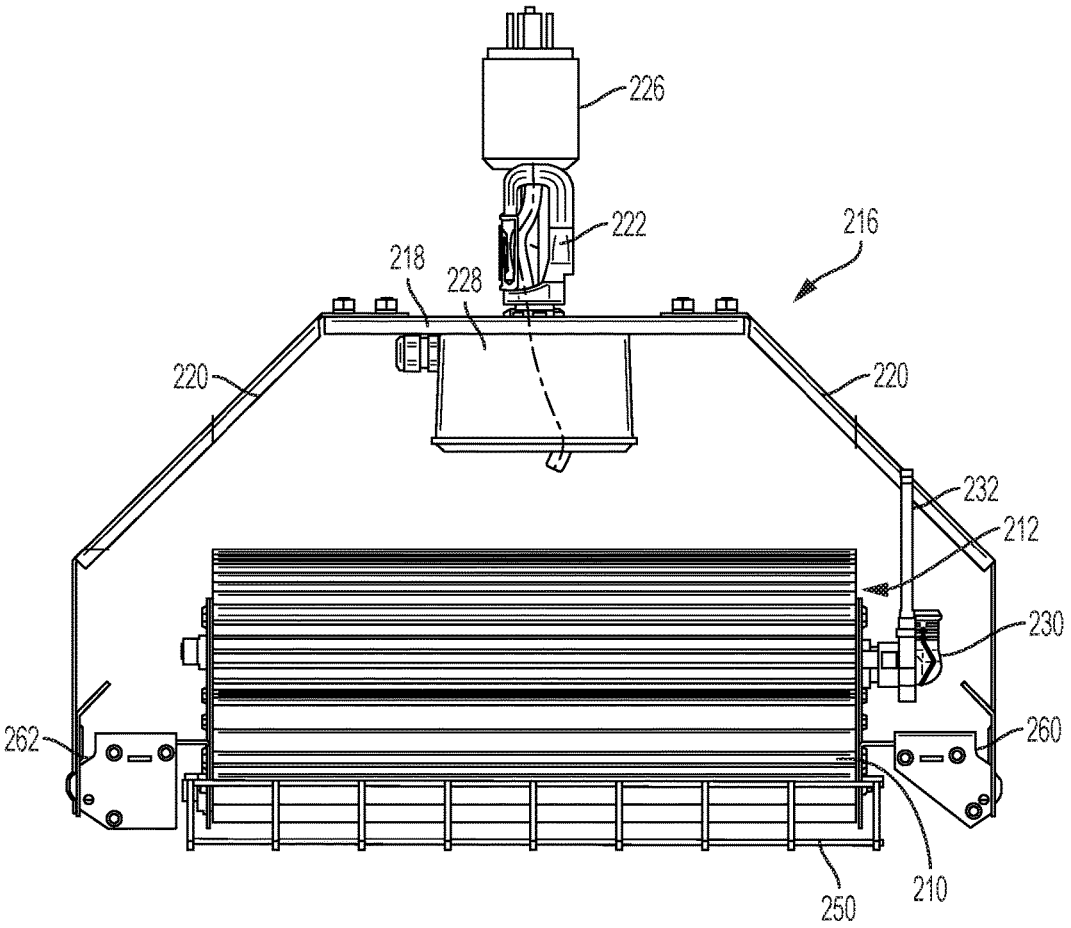
FIG. 28 is an front view of the luminaire of FIG. 27.
Figure 29:
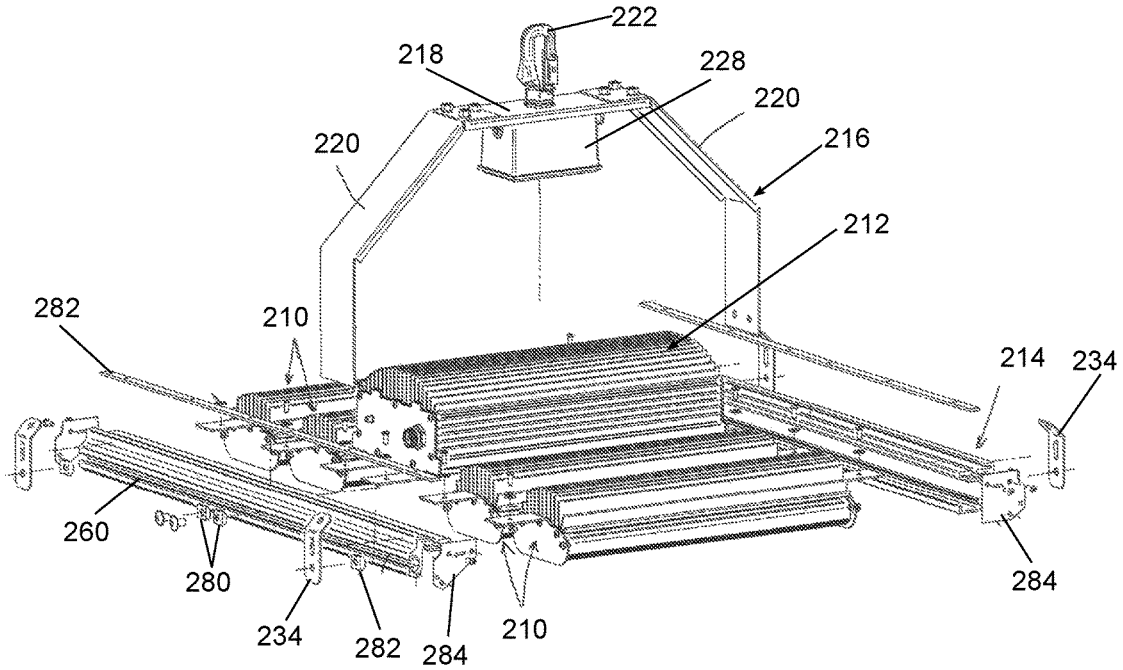
FIG. 29 is a partially exploded view of the luminaire of FIG. 27.

FIGS. 27-29 show another exemplary embodiment of a luminaire that includes four light bar assemblies 210 and a control component assembly 212 connected to a rail assembly 214, with two light bar assemblies 210 positioned on each side of the control component assembly 212. The rail assembly 214 provides support and an attachment point for the light bar assemblies 210 and the control component assembly 212. The light bar assemblies 210 and control component assembly 212 can be identical to, or share a number of similar features with the light bar assemblies 10 and control component assemblies 212 shown in FIGS. 1-26.

Figure 30:
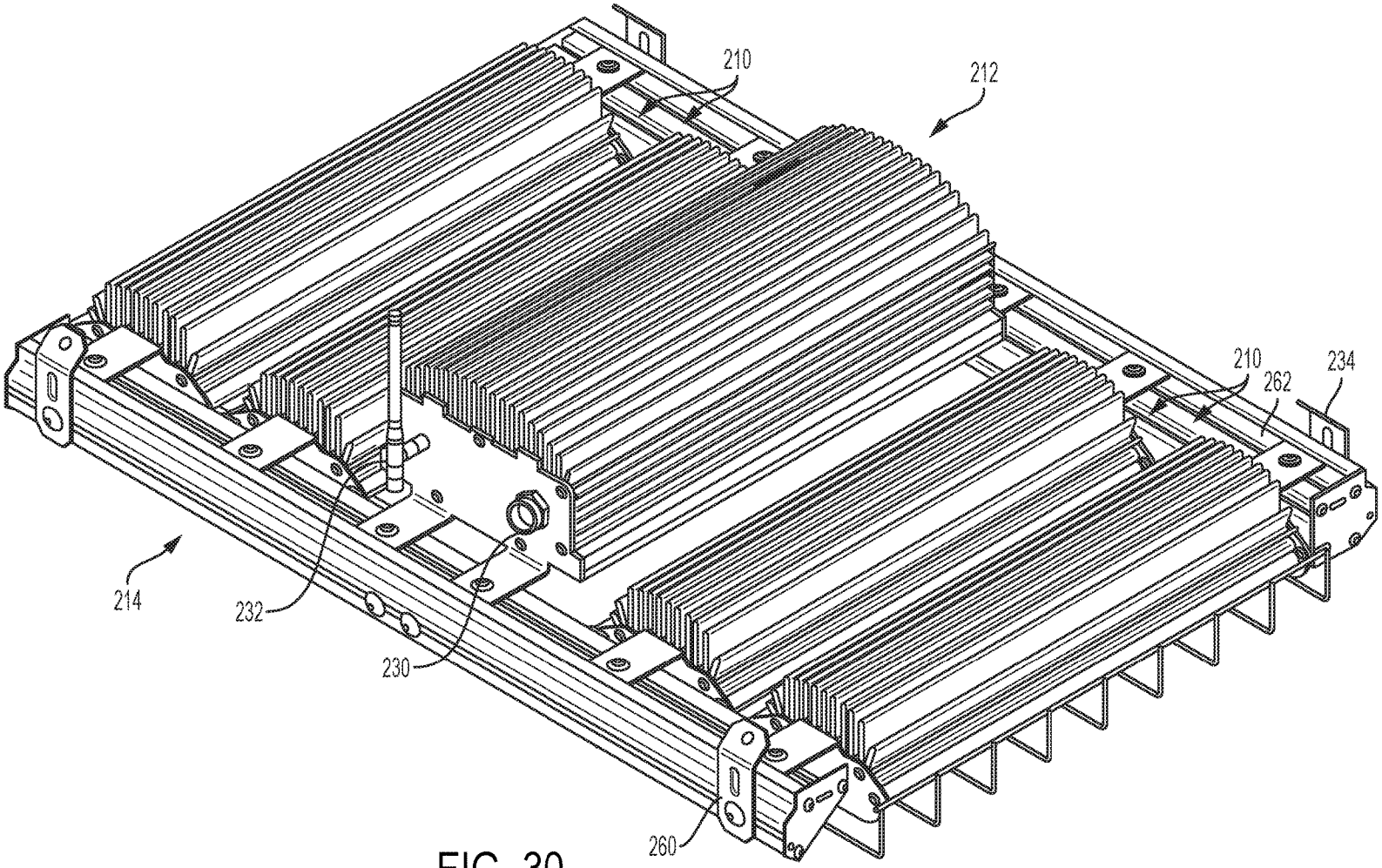
FIG. 30 is a perspective view of a luminaire with a yoke assembly removed and hanger brackets attached.

FIGS. 27 and 28 show the rail assembly 214 is connected to a yoke assembly 216 that can be used to support the luminaire and to provide electrical connections to the control component assembly 212. The yoke assembly 216 includes a base 218 and first and second arms 220 extending from the base 218 to the rail assembly 214. The arms 220 include a top portion connected to the base, an intermediate portion, and a lower portion connected to the rail assembly 214. The top and lower portions can be connected by one or more fasteners, and the intermediate portion can be angled with respect to the top and lower portions. The base 218 includes a threaded member receiving a mounting component, such as a hook mount 222 or a pendant mount (not shown). A first electrical conductor 224 and plug 226 can be connected to the top part of the base 218 and a junction box 228 extends from the bottom of the base 218. The first electrical conductor 224 and plug 226 provide an electrical connection to the junction box 228, and a second electrical conductor (not shown) can extend from the junction box 228 to the control component assembly 212. The control component assembly 212 can include a connector 230 for receiving the second conductor. The connector 230 can be a 90 degree or elbow type connector. The control component assembly 212 can also include an antenna 232 to provide a wireless connection between a user or control system and control components positioned in the control component assembly 212. FIG. 30 shows an alternative mounting assembly that utilizes a series of hanger brackets 234 connected to the rail assembly 214 that can be used to suspend the luminaire with one or more cables.

Figure 31:
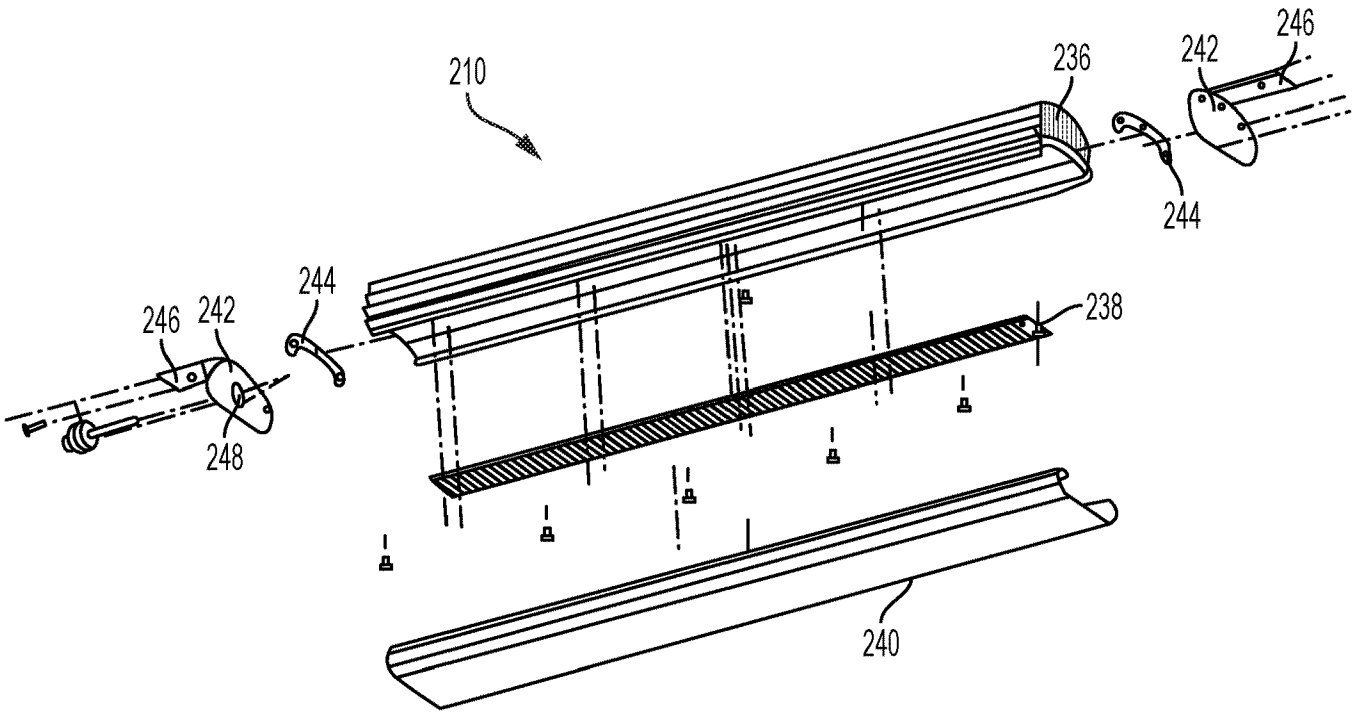
FIG. 31 is a perspective, exploded view of an exemplary light bar assembly.
Figure 32:
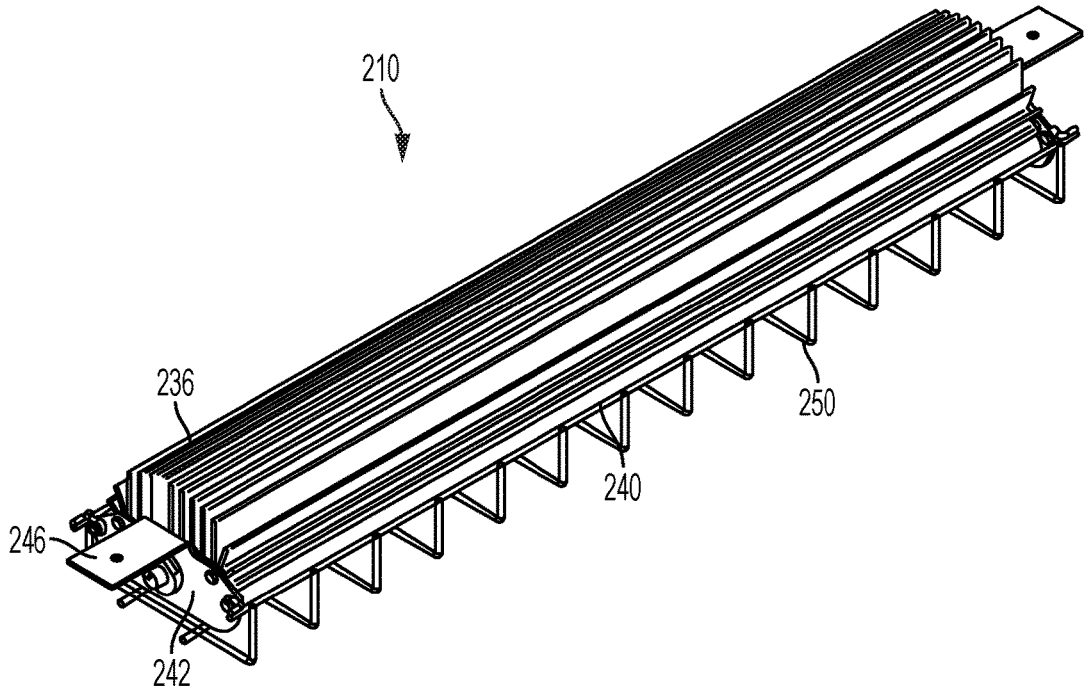
FIG. 32 is a top perspective view of the light bar assembly of FIG. 31.
Figure 33:
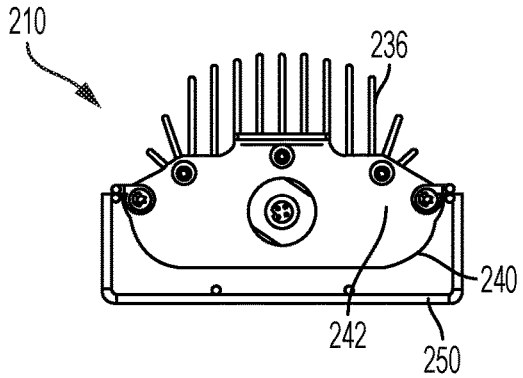
FIG. 33 is a front view of FIG. 32.
Figure 34:
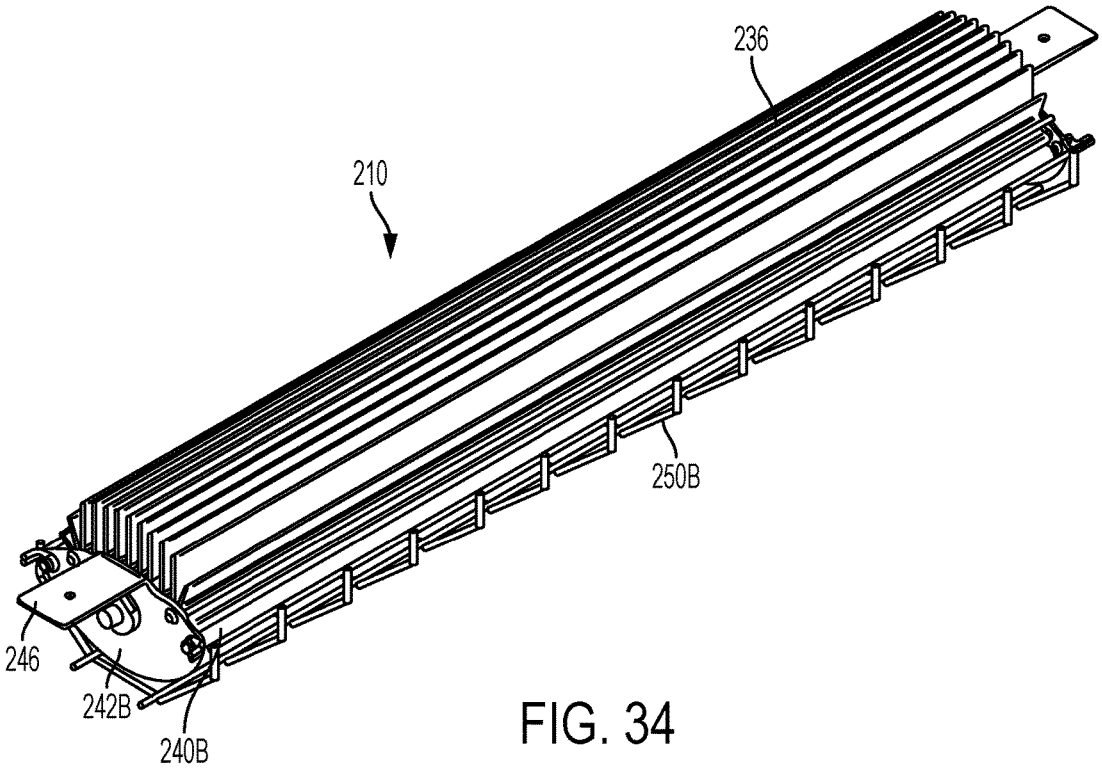
FIG. 34 is a top perspective view of the light bar assembly of FIG. 31 having a different lens.
Figure 35:
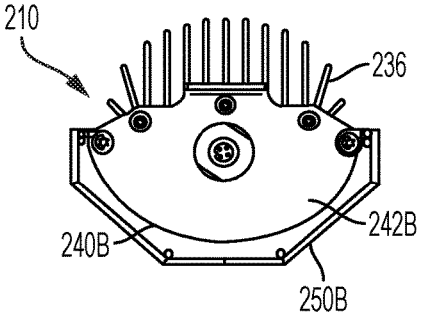
FIG. 35 is a front view of FIG. 34.

FIGS. 31-33 show various exemplary embodiments of a light bar assembly 10 that includes a light bar 236 and a light emitter 238, a lens 240, and a pair of endplates 242 connected to the light bar 236. The light emitter 238 includes one or more LEDs and is connected to the light bar 236 through one or more fasteners. The lens 240 can be snap-fit to the light bar 236. As discussed above, different types of lenses can be connected to the light bar 236, such as the flat lens 240 shown in FIGS. 31-33 or a cylindrical lens 240B as shown in FIGS. 34 and 35. The size and shape of the endplates 242 can also be varied when used with a different type of lens.

The endplates 242 are connected to the light bar 236 through one or more fasteners and a gasket 244 can be positioned between the endplates 242 and the light bar 236. The endplates 242 include a connection feature to connect the light bar assembly 210 to the rail assembly 214. In an exemplary embodiment the connection feature includes a tab 246 that extends from the endplate 236 to engage the rail assembly 214. The tab 246 includes an opening for receiving a mechanical fastener. A conduit 248 can be formed in one of the endplates 242 to allow the light emitters 238 to be electrically connected to one or more control components.

In some exemplary embodiments, the light emitter assembly 210 can include a wire guard 250 that is connected to the end plates 242 as best shown in FIGS. 32 and 33. The wire guard 250 can extend around the lens 240 to provide impact protection. FIGS. 32 and 33 show a wire guard 250 configured to be used with a flat lens 240 and FIGS. 34 and 35 show a wire guard 250B configured to be used with a cylindrical lens 240B.

Figure 36:
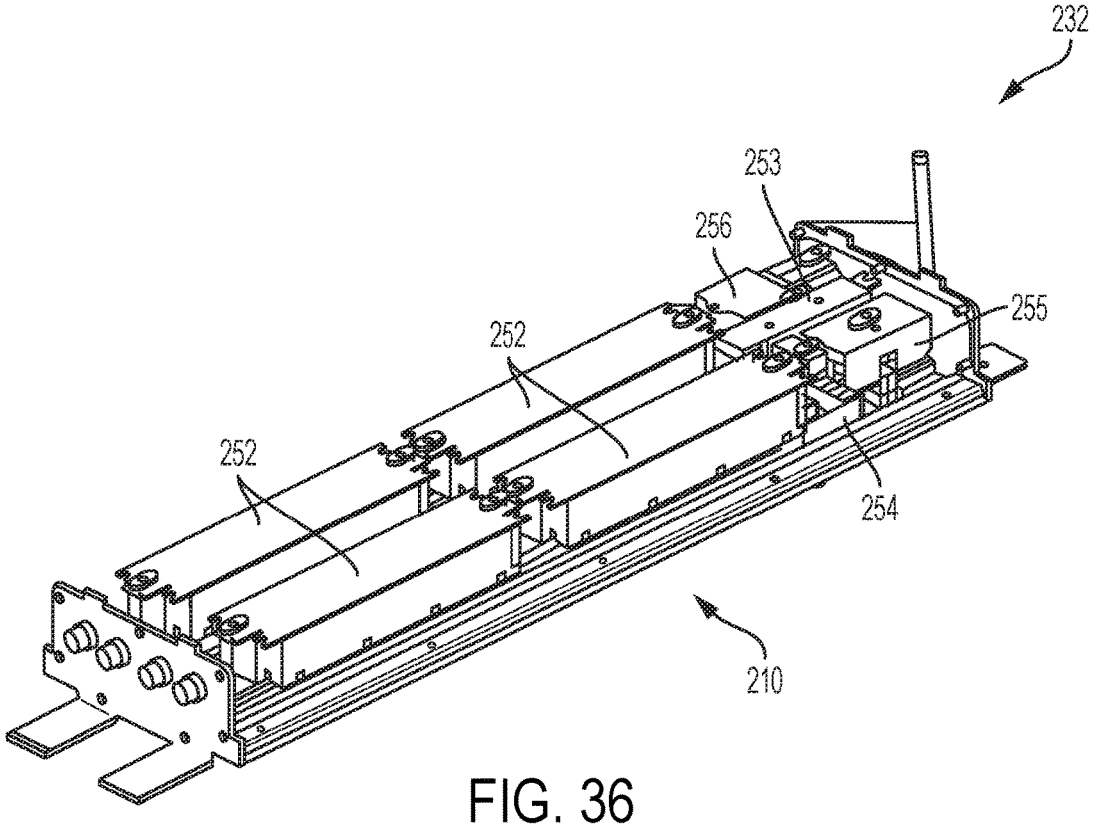
FIG. 36 is a top perspective view of an exemplary control component assembly with the top and side walls of the control housing removed and showing an exemplary set of control components.
Figure 37:
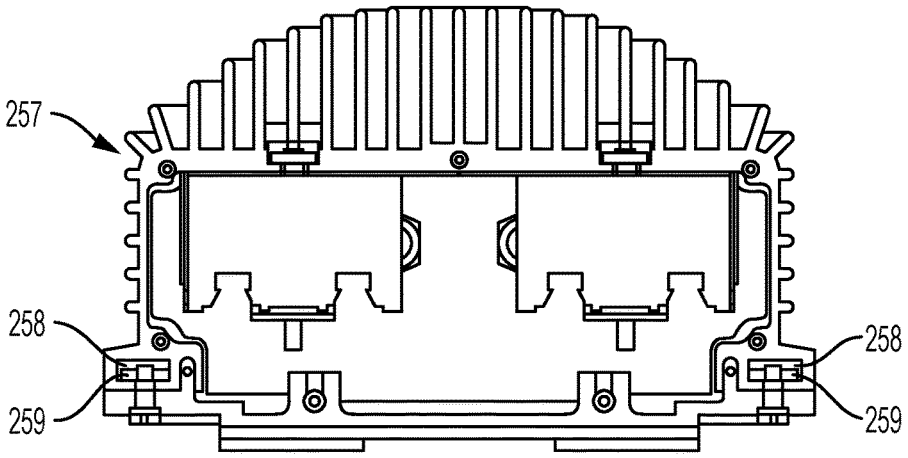
FIG. 37 is a front, sectional view of an exemplary control component assembly.

FIG. 36 show an exemplary embodiment of the interior of the control component assembly 212 having a control component setup that includes four drivers 252, a wiHubb module 253, a wiScape module 254, a fuse assembly 255, and a surge suppressor assembly 256. FIG. 37 shows a sectional view of the control component assembly housing 257 that can be substantially similar to the housing shown in FIG. 16. The control component assembly housing 257 includes a pair of T-shaped side channels 258. Fasteners, such as T-bolts can be used to connect components to the side channels 258. A bar 259 can be slidably inserted into the side channels 258. Differently spaced openings can be provided in the bar 259 to receive fasteners to connect different components at different locations.

Figure 38:
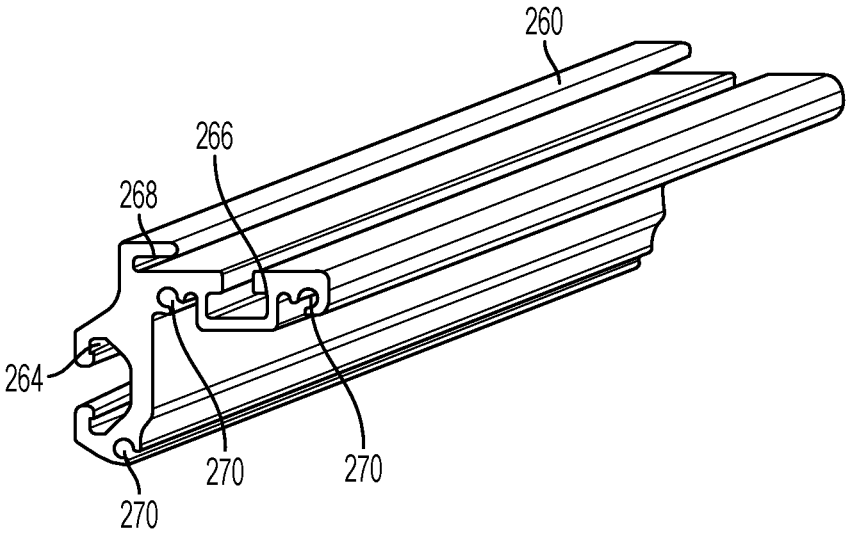
FIG. 38 is a perspective view of an exemplary first rail.
Figure 39:
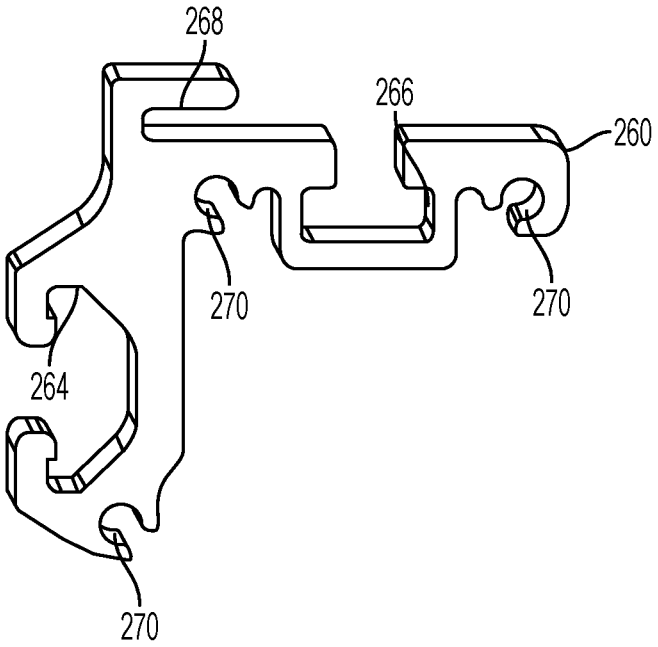
FIG. 39 is a front view of FIG. 36.
Figure 40:
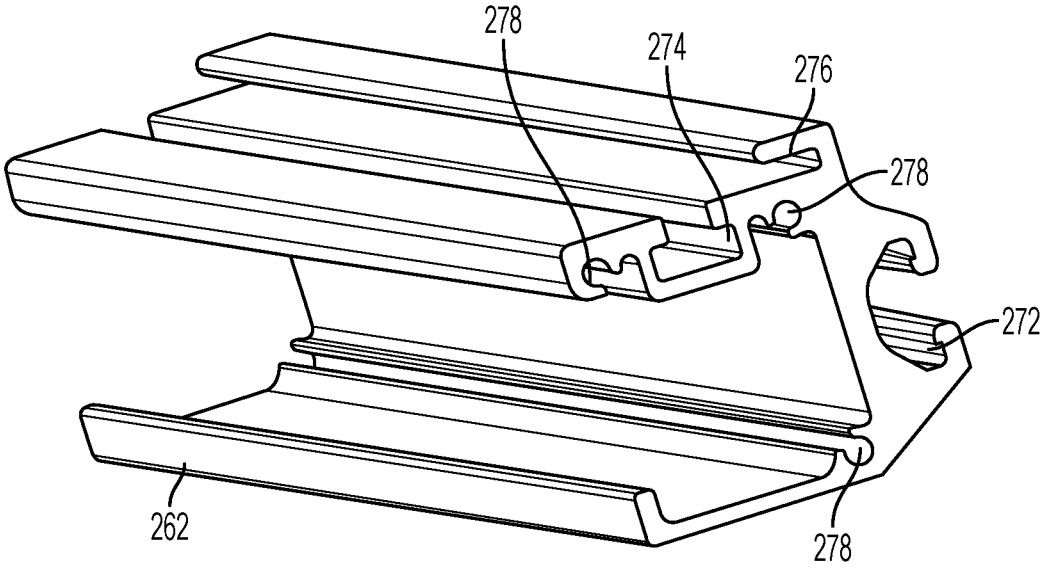
FIG. 40 is a perspective view of an exemplary second rail.
Figure 41:
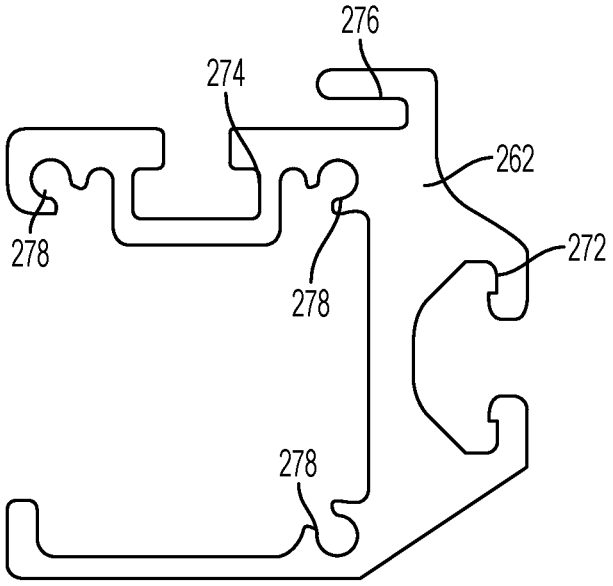
FIG. 41 is a front view of FIG. 38.

The rail assembly 212 includes a first rail 260 and a second rail 262. FIGS. 38 and 39 show an exemplary embodiment of a first rail 260 and FIGS. 40 and 41 show an exemplary embodiment of a second rail 262. The first and second rails 260, 262 can be made from a variety of materials and by a variety of manufacturing processes. In an exemplary embodiment, an extrusion process is used to form the first and second rails 260, 262 to any desired length. The first and second rails 260, 262 include various different connecting features to attach different components to the rail assembly, including the light bar assemblies 210, control component assemblies 212, and mounting components. The first and second rails 260, 262 can also define an interior portion that allows conductors to be run along the rails, for example between the light bar assemblies 210 and the control component assemblies 212.

In an exemplary embodiment the connecting features of the first rail 260 include a side channel 264, an upper channel 266, an upper slot 268, and one or more inner channels 270. In an exemplary embodiment, the connecting features of the second rail 262 include a side channel 272, an upper channel 274, an upper slot 276, and one or more inner channels 278. The side channels 264, 272 are configured to receive a fastener that can connect, for example, mounting components such as the yoke assembly 216 and the hanger brackets 234. As best shown in FIG. 29, the side channels 264, 272 can receive mounting blocks 280 that slidably engage the side channels 264, 272 and connect to another fastener component such as a screw or rivet. The side channels 264, 272 are shown with a substantially C-shaped configuration, although other configurations can be used. The upper channels 266, 274 receive fasteners that extend through the openings in the endplate tabs for the light emitter assembly 210 and the control component assembly 212. The upper slots 268, 276 receive the endplate tabs. In an exemplary embodiment the upper channels 266, 274 are T-shaped channels. Fasteners, such as T-bolts can be used to connect components to the upper channels 266, 274. As shown in FIG. 29, a bar 282 can be slidably inserted into the upper channels 266, 274. Differently spaced openings can be provided in the bar 282 to receive fasteners to connect different components at different locations. The inner channels 116, 126 are configured to receive fasteners that connect end covers 284 to the first and second rails 20, 22.

Various exemplary embodiments are also directed to a method of making and assembling a luminaire. A rail assembly is selected, for example a first rail 20, 260 and a second rail 22, 262 are selected. In an exemplary embodiment the rails can include a side channel, an upper channel, an upper slot, and one or more inner channels. The rails can be formed through extrusion to have a desired length. At least one light bar assembly 10, 210 and at least one control component assembly are connected to the first and second rails 10, 210 as discussed herein. Different lenses and a wire guard can be selectively connected to the light bar assembly 10, 210 as discussed herein. Electrical connections can be made from a power source, to the control component assembly 12, 212, and then to the different light bar assemblies 10, 210. Quick connectors can be associated with the light bar assemblies 10, 210 and control component assembles 12, 212 to facilitate easy connection during manufacture and installation. An assembled luminaire can then be mounted, for example to a yoke or a wire suspension as discussed above. In an exemplary embodiment, the rails, light bars and control component housings are formed through an extrusion process, so that each of these components can be formed to a required size to accommodate different light outputs.

The number and type of light bar assemblies 10, 210 used in each luminaire can vary. The number and type of control component assemblies used in each luminaire can also vary. For example, two to six light bar assemblies 10, 210 can be used with a control component assembly 12, 212 positioned either in the middle, between one or more, or at the ends of the light bar assemblies 10, 210. In another example, between five and eight light bar assemblies 10, 210 can be used with two control component assemblies 12, 212, with one control component assembly 12, 212 positioned at each end of the luminaire.

In certain exemplary embodiments the luminaires can be used in harsh environments that can include high temperatures. For example the luminaires can be used as industrial light fixtures that can survive in ambient temperatures of approximately 65 degrees Celsius. The luminaires can also be rated to be water resistant so that they can be used in damp or wet locations or washed down. Although the exemplary embodiments are described and shown as being used with highbay and lowbay luminaires, the described embodiments may also be incorporated into other types of luminaires.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a rail assembly including a first rail having an exterior facing first channel and a second rail having an exterior facing second channel;

a light bar assembly releasably connected to the first channel and the second channel and extending between the first rail and the second rail, wherein the light bar assembly includes a light bar and a light emitter connected to the light bar, and wherein the light bar assembly includes an end plate and a connector, the end plate having a tab for coupling the light bar to one of the first and second rails and the connector providing an electrical connection to the light bar; and a control component assembly releasably connected to the rail assembly extending between the first rail and the second rail and operatively connected to the light bar assembly, wherein the control component assembly includes a control component housing containing at least one driver, and wherein the driver is operatively connected to the light emitter.

2. The luminaire of claim 1, wherein the light bar includes a base and a plurality of fins extending from the base opposite the light emitter.

3. The luminaire of claim 1, wherein the control component housing includes a top wall, a first side wall, a second side wall, and a bottom wall at least partially defining an interior.

4. The luminaire of claim 2, wherein the light bar includes a pair of arms extending from the base, wherein each arm at least partially defines a channel.

5. The luminaire of claim 4, further comprising a lens releasably secured to the channel.

6. The luminaire of claim 3, wherein the bottom wall is releasably connected to the side walls.

7. The luminaire of claim 3, wherein the top wall includes a first channel and the first side wall includes a second channel, and wherein a control component is connected to the first channel and the bottom wall is connected to the second channel.

8. The luminaire of claim 3, wherein the bottom wall includes a channel and a control component is connected to the channel.

9. The luminaire of claim 3, wherein a sensor extends through the bottom wall.

10. The luminaire of claim 3, further comprising a first endplate and a second endplate connected to the control component housing, wherein the first endplate includes a first tab connected to the first rail and the second endplate includes a second tab connected to the second rail.

11. The luminaire of claim 6, wherein the first rail includes a side channel and an upper channel, and wherein a mounting component is connected to the side channel and the light emitter assembly and the control component assembly is connected to the upper channel.

12. The luminaire of claim 7, wherein the first channel and the second channel have a T-shaped configuration.

13. A luminaire comprising:

a rail assembly comprising a first rail including a first channel and a second channel and a second rail including a third channel and a fourth channel;

a light bar assembly connected to the first channel and the third channel, the light bar assembly including an end plate and a connector, the end plate having a tab for coupling the light bar to one of the first and second rails and the connector providing an electrical connection to the light bar;

a control component assembly connected to the first channel and the third channel; and a mounting component connected to the second channel and the fourth channel.

14. The luminaire of claim 13, wherein the tab includes an opening, and a fastener extends through the opening into the first channel.

15. The luminaire of claim 13, wherein the second channel has a C-shaped configuration and the mounting component is connected to a mounting block positioned in the second channel.

16. The luminaire of claim 13, wherein the mounting component includes a yoke assembly having a base, a first arm connected to the first rail, and a second arm connected to the second rail.

17. The luminaire of claim 13, wherein the mounting component includes a set of hanger brackets for receiving a cable.

18. The luminaire of claim 13, wherein the first rail at least partially defines an interior and a conductor extends from the control component assembly to the light bar assembly through the interior.

19. The luminaire of claim 14, wherein first channel has a T-shaped configuration and a bar is positioned in the first channel, the bar having a second opening receiving the fastener.

20. The luminaire of claim 14, wherein the first rail further comprises a first slot and the tab extends into the first slot.

21. The luminaire of claim 14, wherein the base has a connection portion for receiving a hook mount or a pendant mount.

* * * * *